US007374625B2

(12) United States Patent
Panetta et al.

(10) Patent No.: US 7,374,625 B2
(45) Date of Patent: May 20, 2008

(54) SYSTEMS AND METHODS FOR A ROBOTIC TAPE APPLICATOR

(75) Inventors: Richard Panetta, Milton (CA); Ylli Yryku, Georgetown (CA); Tyler Wright, Toronto (CA); Terrance M. Sharp, Milton (CA)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 11/203,121

(22) Filed: Aug. 15, 2005

(65) Prior Publication Data

US 2006/0054272 A1 Mar. 16, 2006

Related U.S. Application Data

(60) Provisional application No. 60/601,139, filed on Aug. 13, 2004, provisional application No. 60/601,656, filed on Aug. 16, 2004, provisional application No. 60/623,066, filed on Oct. 29, 2004.

(51) Int. Cl.
*B32B 41/00* (2006.01)
*B29C 65/50* (2006.01)

(52) U.S. Cl. ..... 156/64; 156/250; 156/353

(58) Field of Classification Search ..... 156/64, 156/250, 353, 361, 367, 368
See application file for complete search history.

(56) References Cited

U.S. PATENT DOCUMENTS

| | | | | |
|---|---|---|---|---|
| 4,130,873 | A | 12/1978 | Fioretta et al. | 364/513 |
| 4,382,836 | A | 5/1983 | Frank | 156/459 |
| 4,750,966 | A | 6/1988 | Koller | 156/391 |
| 4,759,810 | A | 7/1988 | Jackson et al. | 156/64 |
| 4,885,981 | A | 12/1989 | Roettger et al. | 92/59 |
| 4,978,417 | A | 12/1990 | Grimshaw et al. | |
| 4,980,011 | A | 12/1990 | Gruber et al. | 156/361 |
| 4,997,513 | A | 3/1991 | Lengen et al. | 156/523 |
| 5,041,179 | A | 8/1991 | Shinno et al. | 156/64 |
| 5,342,647 | A | 8/1994 | Heindel et al. | 427/2.31 |
| 5,352,306 | A | 10/1994 | Grimshaw et al. | 156/64 |
| 5,462,633 | A | 10/1995 | Manusch et al. | 156/577 |
| 5,536,342 | A | 7/1996 | Reis et al. | 156/64 |

(Continued)

FOREIGN PATENT DOCUMENTS

FR 2621517 4/1989

(Continued)

OTHER PUBLICATIONS

Publication from Cincinnati Milacron titled, "Into the Future," 22 pp., published 1988.

(Continued)

*Primary Examiner*—George Koch
(74) *Attorney, Agent, or Firm*—Hunton & Williams

(57) ABSTRACT

Methods and systems for applying material onto a work piece. In one described method, path storing path data for a predetermined path for applying a material to a work piece is stored in an electronic database. Length data length data for the length of the material to applied to the work piece is stored in an electronic database. A controller determines when to cut the material. Using a material applicator apparatus, the material is applied to the work piece along the predetermined path. Using a cutting component in the material applicator apparatus, the material is cut.

28 Claims, 15 Drawing Sheets

U.S. PATENT DOCUMENTS

| | | | | |
|---|---|---|---|---|
| 5,709,162 | A | 1/1998 | Pagett et al. | 112/470.07 |
| 5,714,034 | A | 2/1998 | Goodhue | 156/512 |
| 5,738,749 | A | 4/1998 | Grimshaw et al. | 156/312 |
| 5,779,830 | A | 7/1998 | Wakefield et al. | 156/64 |
| 5,830,297 | A | 11/1998 | Nakahira et al. | 156/64 |
| 5,938,871 | A | 8/1999 | Nakahira et al. | 156/64 |
| 5,968,297 | A | 10/1999 | Hooker et al. | 156/64 |
| 6,113,716 | A | 9/2000 | Schramayr et al. | 156/64 |
| 6,189,587 | B1 | 2/2001 | Cairns | 156/351 |
| 6,440,249 | B1 | 8/2002 | Swinburne | 156/230 |
| 6,537,406 | B1 | 3/2003 | Jensen, Jr. et al. | 156/202 |
| 6,638,590 | B2 | 10/2003 | Ourth | 428/40.1 |
| 6,645,327 | B2 | 11/2003 | Austin et al. | 156/64 |
| 2002/0124967 | A1 | 9/2002 | Sharp | 156/378 |
| 2003/0109946 | A1* | 6/2003 | Erickson et al. | 700/96 |
| 2005/0016671 | A1 | 1/2005 | Sharp | 156/269 |
| 2005/0161161 | A1 | 7/2005 | Sharp et al. | 156/353 |

FOREIGN PATENT DOCUMENTS

| | | |
|---|---|---|
| FR | 2639625 | 6/1990 |
| GB | 2101519 | 1/1983 |
| WO | WO 95/29116 | 11/1995 |

OTHER PUBLICATIONS

Publication from Plastics Engineering titled, "R U Reinforcing Plastics With Robots," 10 pp., published May 1981.

* cited by examiner

SYSTEMS AND METHODS FOR A ROBOTIC TAPE APPLICATOR

CROSS-REFERENCE TO RELATED APPLICATIONS

The current application claims priority to and incorporates by reference in its entirety U.S. Provisional Patent Application No. 60/601,139 filed Aug. 13, 2004, U.S. Provisional Patent Application No. 60/601,656 filed Aug. 16, 2004, and U.S. Provisional Patent Application No. 60/623,066 filed Oct. 29, 2004, each application entitled "Systems and Methods for Robotic Tape Applicator."

BACKGROUND OF THE INVENTION

1. Field of the Invention

This invention relates to the field of sealing, adhesives, and applying structural enhancements. In one specific aspect, the invention relates to the field of applying tape onto a work piece using a robot and software.

2. Description of the Related Art

It is known in the art to employ mastics, foams and expandable materials for sealing cavities and joints between components, such as metal, glass, plastic, and composites. Examples of metal components comprise metal panels such as those used in metal buildings, roofing, pipelines, aircraft, medical instruments, marine, non-automotive equipment and vehicles such as tractors, tractor trailers, golf cars, construction equipment, recreational vehicles, etc, and automotive components, among other applications wherein robot assembly is desirable. In the case of automotive components, metal is typically stamped into a desired configuration and the joint between the stamped metal components, or over/under the metal seam, is sealed (e.g., to control wind, dust, noise, water intrusion, metal bonding, structural reinforcement, and function as an adhesion promoter).

In a typical manufacturing operation, a worker seals (including adding an adhesive, or a structural material or sound abatement material) a work piece (e.g., stamped automotive part) by applying tape onto the work piece. The worker is required to maneuver the tape (e.g., a sealant) along a linear or non-linear path, and to apply sufficient pressure on the tape in order to adhere the tape to the work piece. The work piece can have contours which can complicate the tape application. This requires a significant amount of manual dexterity on the part of the worker at various stages, laying down the tape and applying appropriate pressure to the tape in order to ensure that the tape will be fastened securely and function adequately. In addition, when applying two-sided adhesive tape, it is important to cut the tape cleanly and to avoid the paper or backing from sticking to the adhesive after the tape has been cut.

Accordingly, it would be desirable to reduce the time required to perform these taping operations while retaining, or improving the level of precision of a skilled worker. In addition, it would be advantagous to provide a method of applying tape that is uniform, predictable and reproducible, using an apparatus which is cost-effective. U.S. patent application Ser. No. U.S. 2002/0124967A1 (published Sep. 12, 2002) discloses an applicator and method for applying two-sided adhesive tape between two work pieces; the disclosure of which is hereby incorporated by reference.

SUMMARY OF THE INVENTION

Embodiments of the present invention comprise systems and methods for applying material onto a work piece. One aspect of an embodiment of the present invention comprises storing path data for a predetermined path for applying a material to a work piece, storing length data for the length of the material to applied to the work piece, determining when to cut the material, applying the material to the work piece along the predetermined path using a material applicator apparatus, and cutting the material using a cutting component in the material applicator apparatus.

The exemplary embodiment is mentioned not to limit or define the invention, but to provide an example of an embodiment of the invention to aid understanding thereof. Exemplary embodiments are discussed in the Detailed Description, and further description of the invention is provided there. Advantages offered by the various embodiments of the present invention may be further understood by examining this specification.

BRIEF DESCRIPTION OF THE DRAWINGS

The invention may take physical form in certain parts and arrangements of parts, certain aspects and methods which will be described in detail in this specification and illustrated in the accompanying drawings that form a part hereof. Any dimensions shown on the Figures are for illustration purposes only, and the components shown in these Figures can be employed in a wide range of dimensions and configurations.

DETAILED DESCRIPTION OF THE PRESENT INVENTION

Figure 1:
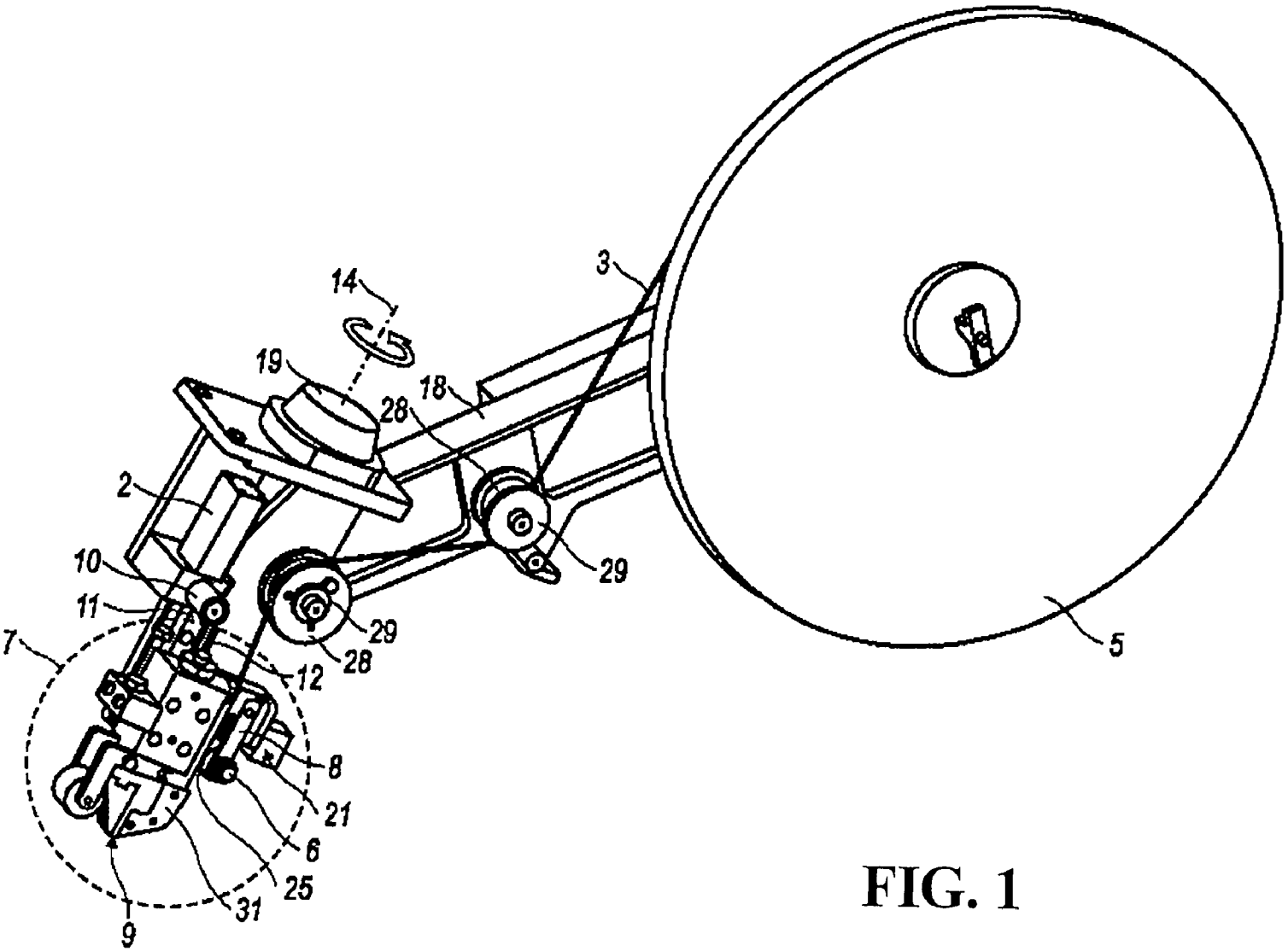
FIG. 1 is a perspective view of a robotic tape applicator in accordance with an exemplary embodiment of the present invention.

The drawings are provided to illustrate certain aspects of the invention and shall not limit the scope of any claims appended hereto. Referring to FIGS. 1-5, a robotic tape applicator in accordance with an exemplary embodiment of the present invention is illustrated. The robotic tape applicator 1 can apply tape 3 onto a work piece. The robotic tape applicator 1 can include a tape applicator head 7, a main bracket 18 and a roller 5 with the main bracket 18 connecting the tape applicator head 7 and the roller 5. The roller 5 can include tape 3 that is stored or rolled onto the roller 5. The roller 5 can include a drive mechanism that is geared or self driven. The tape 3 is drawn from the roller 3 due to adhesion or friction between the tape 3 and a work piece. For example, the tape 3 is applied to a work piece at a predetermined location and remains at this location for a period of time sufficient to permit the tape 3 to adhere to the work piece. The first contact location can be at any desirable location along a path over which the tape 3 will be applied.

The adhesion or bond formed at the first contact location can increase the effectiveness of tape application (e.g., in the case of an oily work piece the initial bond permits the tape to unreel along the application path instead of sliding across the work piece surface without being dispensed). If desired, a downward pressure can be applied at the first contact location. This downward pressure can mimic a manual tape application. If desired, the robotic tape applicator 1 can employ a driven system to apply a sealer instead of using adhesion or friction. A driven system can allow less tension to be applied to the sealer thereby preventing unintended tape 3 dispensing (e.g., uncut tape 3 becomes adhered to the work piece surface thereby causing unintended tape 3 dispensing as the robotic tape applicator 1 is displaced). The robotic tape applicator 1 can be adapted to accommodate a wide range of tape widths.

The tape 3 can be an adhesive, a sealant, sound abatement material, single or double sided, as well as other known types of tapes. Tapes can be used in automotive, industrial, among other applications. Tapes suitable for robotic application can have a wide range of chemical compositions and physical properties. Examples of suitable tapes used in automotive sealing comprise tapes that can be welded through and seal the welded area, tapes with mastic and a thin film (e.g., EPDM, butyl, nitrile, SBR, polybutadiene, metallic filler); tapes having a weld through film only (e.g., EMA, ethylene acrylic, epoxy); tapes having a rigid or structural film (e.g., epoxy or ethylene acrylic); tapes that are heat cured subsequent to application and become rigid or function as structural reinforcements (e.g., nitrile, ethylene acrylic, epoxy, and SBR); tapes having various degrees of temperature resistance (e.g., high temperature resistant compounds such as fluoroelastomer, polysiloxane, ethylene arylic, EPDM, and acrylic and ambient to medium resistant compounds such as butyl, polybutadiene, SPR, nitrile, neoprene and low temperature compounds such as flouro, polysiloxane); heat expandable compositions; paintable sealants; tapes that melt when heated; as well as other tapes know to one of ordinary skill in the art used for automotive applications. Automotive tapes are available from Orbseal LLC, Richmond, Mo.

The tape 3 can also comprise a general purpose material such as PVC, mylar, polyethylene, or similar backings on pressure sensitive mastic, that can used for barrier wrap. An example of such a material comprises the laminar structure disclosed in U.S. Pat. No. 6,638,590B2; the disclosure of which is hereby incorporated by reference. The suitable tape 3 (including its backing material) will depend upon the end use of the tape 3. Examples of suitable backing material comprises at least one member selected from the group consisting of polypropylene film, metallic films, glass weave, Kevlar®, Mylar®, or specially formulated films of flouroelastomer. The tape 3 can also include special fillers in order to obtain certain desirable properties. Examples of suitable fillers comprise at least one member selected from the group of metallic (e.g., magnetic), paintable, ceramic, silicates (e.g., corrosion buffer), conductive graphite, expansion agents (e.g., an encapsulated blowing agent), UV cured or activated, among others.

Using the robotic tape applicator 1, tape 3 is applied to one or more work pieces for sealing, sound abatement, and/or joining the work pieces together. The work pieces can vary in configurations and sizes. For example, tape 3 can be applied to automotive work pieces, including, but not limited to, quarter panel seams/joints/panels; dash panel seams/joints/panels; cowl panel seams/joints/panels; A, B, C, D, or E post seams/joints; rocker or sill seams/joints; wheel arch seams/joints; fuel filler bowl seams/joints; rifle arm or shotgun rail seam/joints/panels; drain channel seam/joints; package tray seams/joints/panels; rood ditch seams/joints; body side to quarter panel seams/joints/panels; lower panel reinforcement seams/joints/panels; plenum chamber seams/joints; roof header and bow seams/joints/panels; hood and rear deck seams/joints/panels; floor pan seams/joints/panels; light can seams/joints; and door intrusion beams/joints/panels.

Referring to FIGS. 1-5 again, the tape 3 is guided along a path through the robotic tape applicator 1 to the tape applicator head 7. Tensioning means 16 can be provided along this path in order to ensure that the tape 3 remains under a uniform tension while tape 3 is being fed. When the robotic tape applicator is placed into operation, the tape applicator head 7 proceeds to a precise location dictated by a robotic controller 44 (see FIG. 6). The tape application then begins. Pressure in the tape applicator head 7 is maintained using a pressure cylinder 2. The point of the tape applicator head 7 closest to the work piece is referred to as the nose 9 which can be constructed to move independently of the rest of the tape applicator head 7. In order to ensure that the tape 3 is applied evenly without damage to the work piece, the nose 9 can move reciprocally up and down in a direction normal to the surface of the work piece. In one aspect, a linear bearing 11 can be used which allows the nose 9 to move vertically in relation to the surface of the work piece with a minimum of friction. Irregular motion of the tape applicator head 7 can introduce uneven tensions into the tape 3 itself, so freedom of vertical motion for the tape applicator head 7 is generally advantageous.

The amount of downward vertical force on the tape applicator head 7 depends upon the tackiness of the tape 3, surface characteristics of the work piece, among other variables affecting adhesion between the tape 3 and work piece. If desired, a constant pressure can be maintained on the tape applicator head 7 by means of the pressure cylinder 2, typically regulated by hydraulic or pneumatic forces, which assists in downward vertical force and allows the tape applicator head 7 to be in constant compliance with the work piece. In addition, lips or projections 15, as shown in FIGS.

3 and 5, on the side of the tape applicator head 7 can be provided to ensure constant compression of the tape 3. The vertical dimensions of the lips 15 between which the tape 3 runs can be slightly less than the thickness of uncompressed tape 3 so that a defined amount of compression of the tape 3 can be created when the lips 15 are maintained in contact with the work piece.

Figure 3:
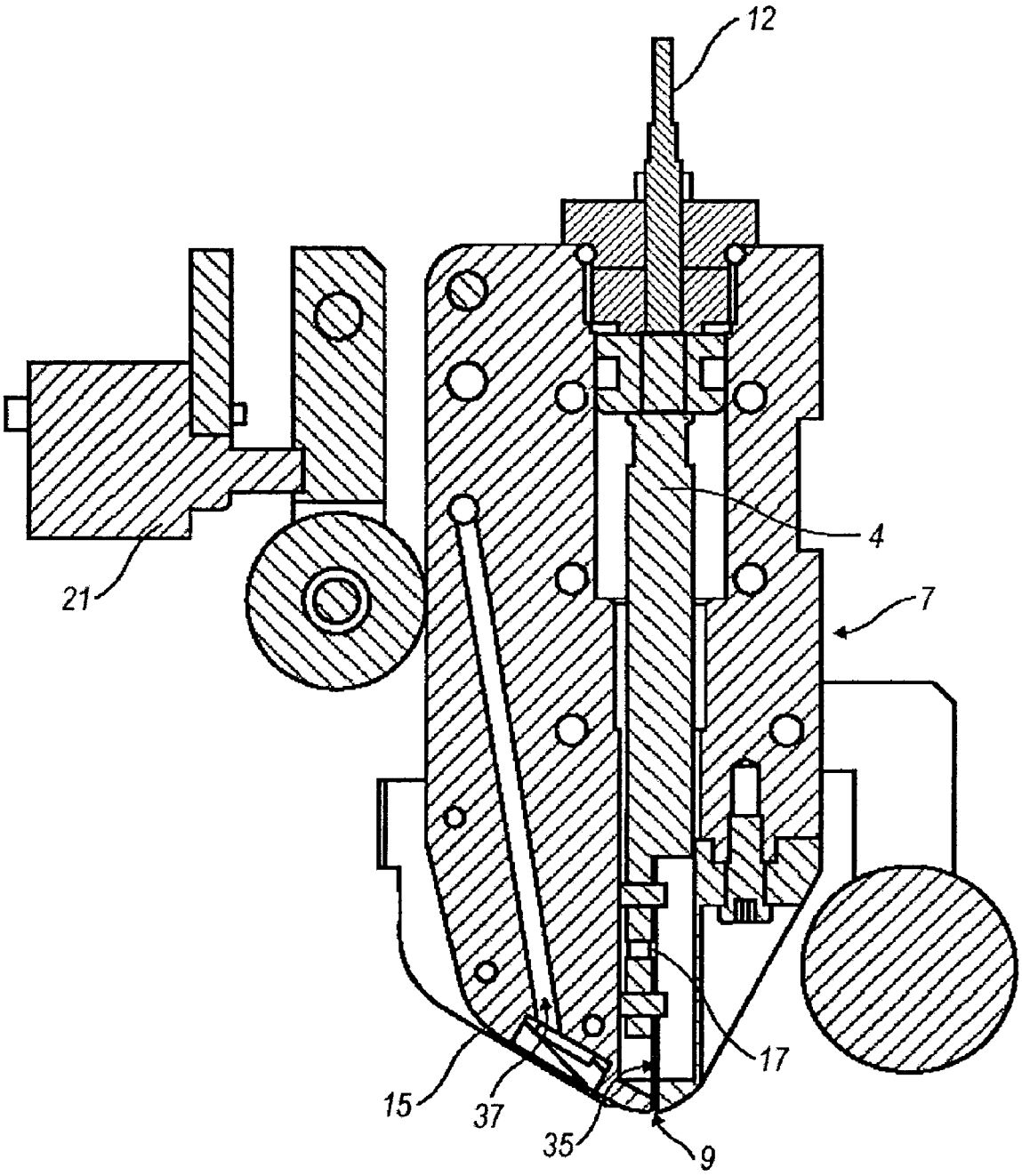
FIG. 3 is a cross-sectional elevation view of a tape applicator head in accordance with an exemplary embodiment of the present invention.
Figure 4:
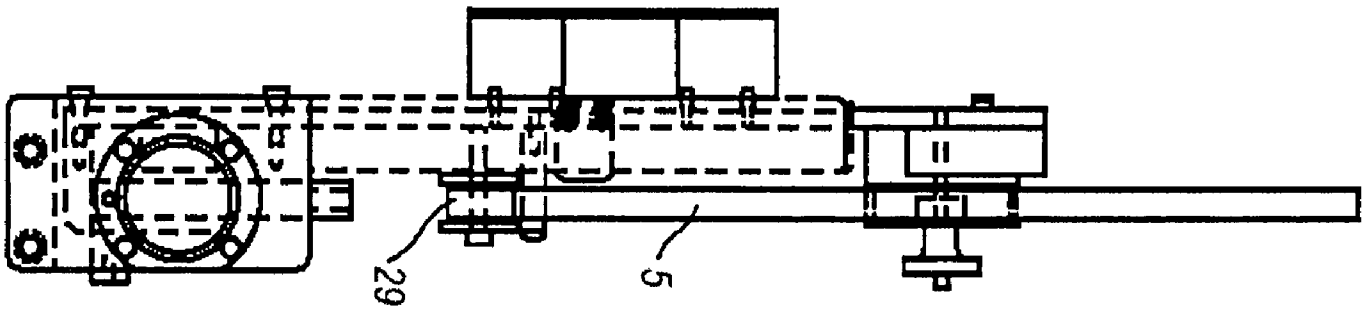
FIG. 4 is a top elevation view of a robotic tape applicator in accordance with an exemplary embodiment of the present invention.
Figure 5:
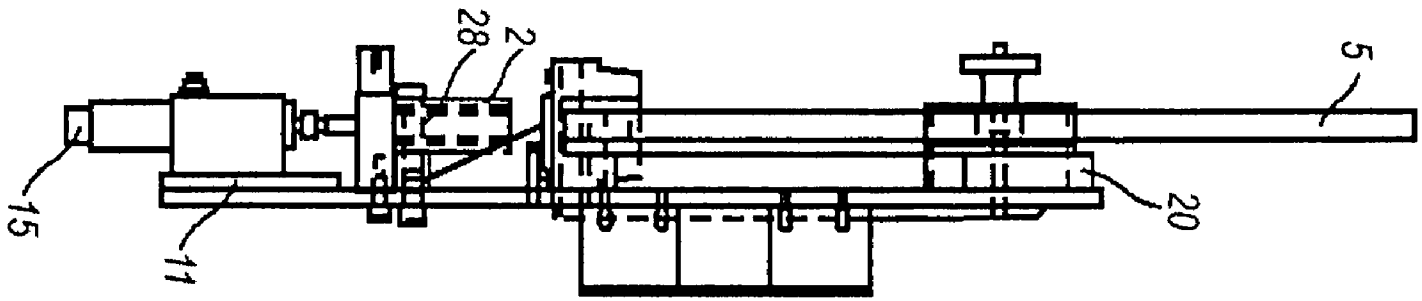
FIG. 5 is a side elevation view of a robotic tape applicator in accordance with an exemplary embodiment of the present invention.

In order to apply tape 3 in a controlled fashion, it is preferred to cut the tape 3 while the tape applicator head 7 remains in contact with the work piece so that the tape 3 that has been applied will not be pulled away from the work piece. In one aspect, as illustrated in FIG. 3, a cutting means comprising a knife blade 17 is provided which is located within the external profile of the tape applicator head 7. For certain work pieces, it is necessary for the tape applicator head 7 to move within a fairly narrow or confined space, therefore a small nose on the tape applicator head 7 can be beneficial. Preferably, the knife blade 17 is incorporated into the nose 9 so that it does not protrude when the tape is in motion. If the knife blade 17 is not fully retracted before the tape 3 is applied, the tape 3 can be cut or scraped in an unwanted manner. Imperfections in the tape 3, such as an unwanted cut or scrape can cause problems when separating the backing 6 from the tape 3. When the tape 3 is not cut correctly, the tape 3 can become contaminated, can fold onto itself, etc. Accordingly, in a preferred embodiment, a knife blade sensor 12 is provided to ensure that the knife blade 17 is fully retracted before tape application commences or recommences, thus reducing the opportunity for undesired imperfections in the tape 3.

The knife blade 17 can operate under the control of a knife blade control piston 4. Referring to FIG. 1, when it is desired to cut the tape 3, a braking assembly 21 presses the tape 3 firmly into contact with a portion of the tape applicator head 7. The braking assembly 21 locks the tape 3 so that as the tape applicator head 7 pulls away from the work piece, the tape 3 does not unwind any further from the roller 5. Due to the orientation of the tape 3 as it is laid down, the braking assembly 21 applies pressure against the adhesive side of the tape 3. Accordingly, it is preferable that the surface of the tape applicator head 7 that comes into contact with the tape 3 comprises a non-stick surface so that it will not adhere to the adhesive side of the tape 3. A spring-loaded lever 8 can pivot in order to trap the tape 3 in this assembly. An air release mechanism 10 releases the brake. As set out above, the braking assembly 21 locks the tape 3 in place during tape cutting in order to prevent tape movement. It is intended that the tape 3 should remain in contact with the work piece without any movement after the tape 3 has been laid down. The pressure cylinder 2 is locked when the brake assembly 21 is applied. Locking the pressure cylinder 2 assists in preventing the force of the cutting means, e.g., knife blade 17, from causing the nose 9 to move, which reduces the effectiveness of the cut.

It is beneficial to maintain a constant tension on the tape 3 during tape application. Inconsistent tension on the tape 3 can cause the tape 3 to break and/or can cause the tape 3 to be cut in improper lengths, e.g., shorter or longer of the desired length. In one aspect, one or more nip rollers 25 can provide a point of constant tape tension regardless of the amount of tape 3 on the roller 5. As the radius of the tape 3 on the roller 5 decreases, the tension on the tape 3 can vary unless such a tape tensioning means is employed. The nip rollers 25, 74 (one shown in FIG. 1 and two shown in FIG. 12) can include a polished steel shaft with a sapphire tube over the shaft to create a small diameter roller for the tape 3 to run over (see 66 in FIG. 15). This reduces the friction of the tape 3 on the nose 9 due to the capstan effect and thus further reduces the torque required to feed the tape 3 through the tape applicator head 7.

In order to keep the tape 3 moving completely in line with the tape applicator head 7, side guides can be provided. In one aspect, crown guides 28 on the idler rollers 29 keep the tape 3 moving in a straight line with the tape applicator head. These side guides can also include a non-stick coating in order to prevent the tape 3 from dragging, thus avoiding unwanted tensions. Side guide plates 31 can be located at one or more locations on the tape applicator head 7 in order to help guide the tape 3. In one embodiment, the side guide plates 31 are extended down to the application area of the nose 9 as shown in FIG. 1. This is critical for maintaining the proper tape tension and guidance when the tape applicator head 7 is negotiated around tight curves.

Figure 2:
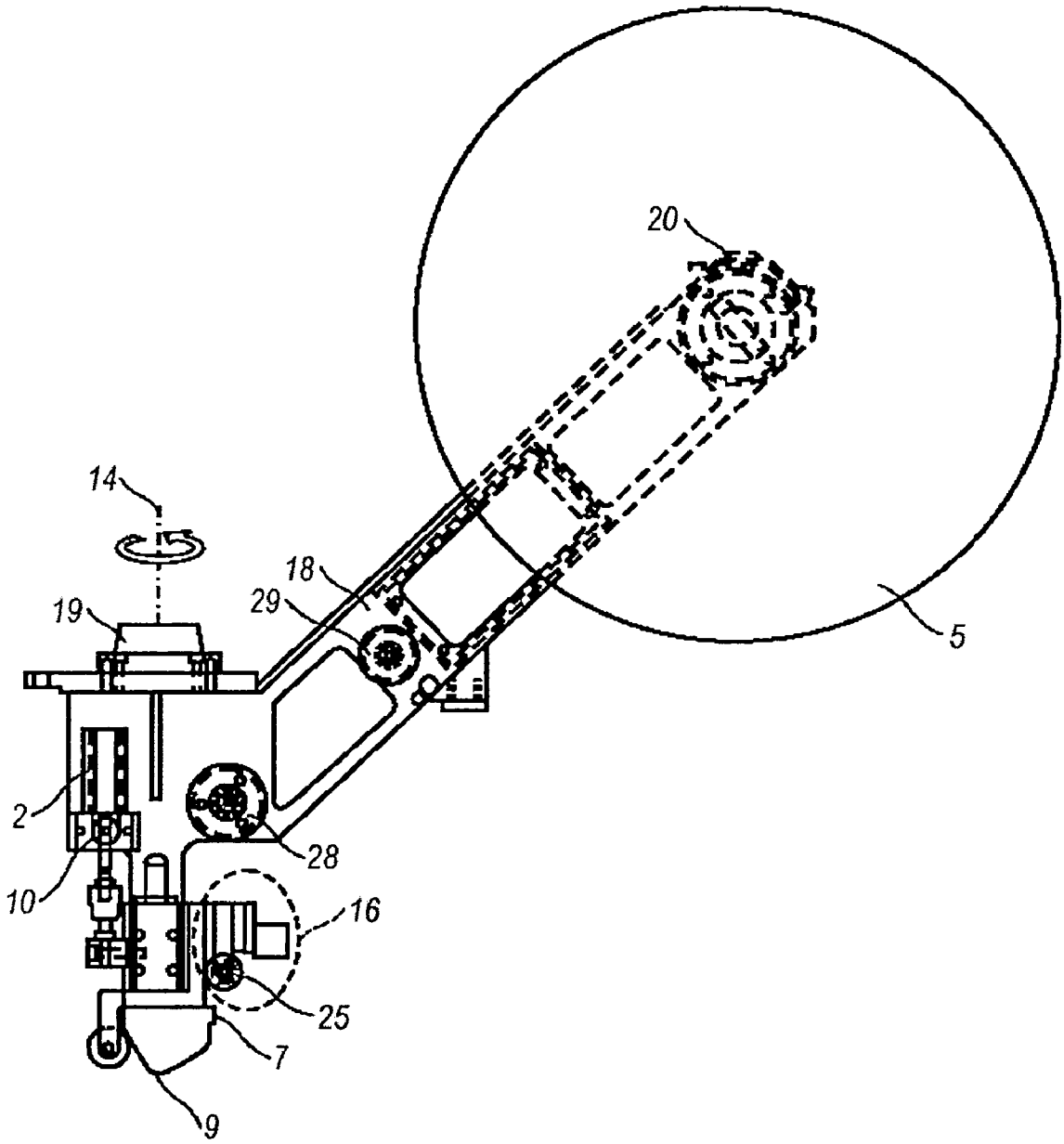
FIG. 2 is a front elevation view of a robotic tape applicator in accordance with an exemplary embodiment of the present invention.

The shape of the nose 9 can affect the efficiency of tape application. A smooth radius at the tip of the nose 9 prevents excess tension in the tape 3. If the center point 35 of the radius of the nose tip (as shown in FIG. 3) is in line with the roll axis 14 of the robot arm (as shown in FIGS. 1 and 2), optimum results appear to be obtained. The roll axis 14 of the robot is the tool point around which the robot rotates. When the center point 35 of the radius at the tip of the nose 9 is in line with the roll axis 14 of the robot, it is possible to take advantage of the circular programming functions of the robot to create extremely smooth arcing motions. According to another embodiment of the present invention, the tape application area of the nose 9 can be flattened out just before the backing/tape separation interface. This allows the compliance pressure load to be spread over a larger area and eliminates creases in the tape 3 during the tape application due to high point loading.

Figure 15:
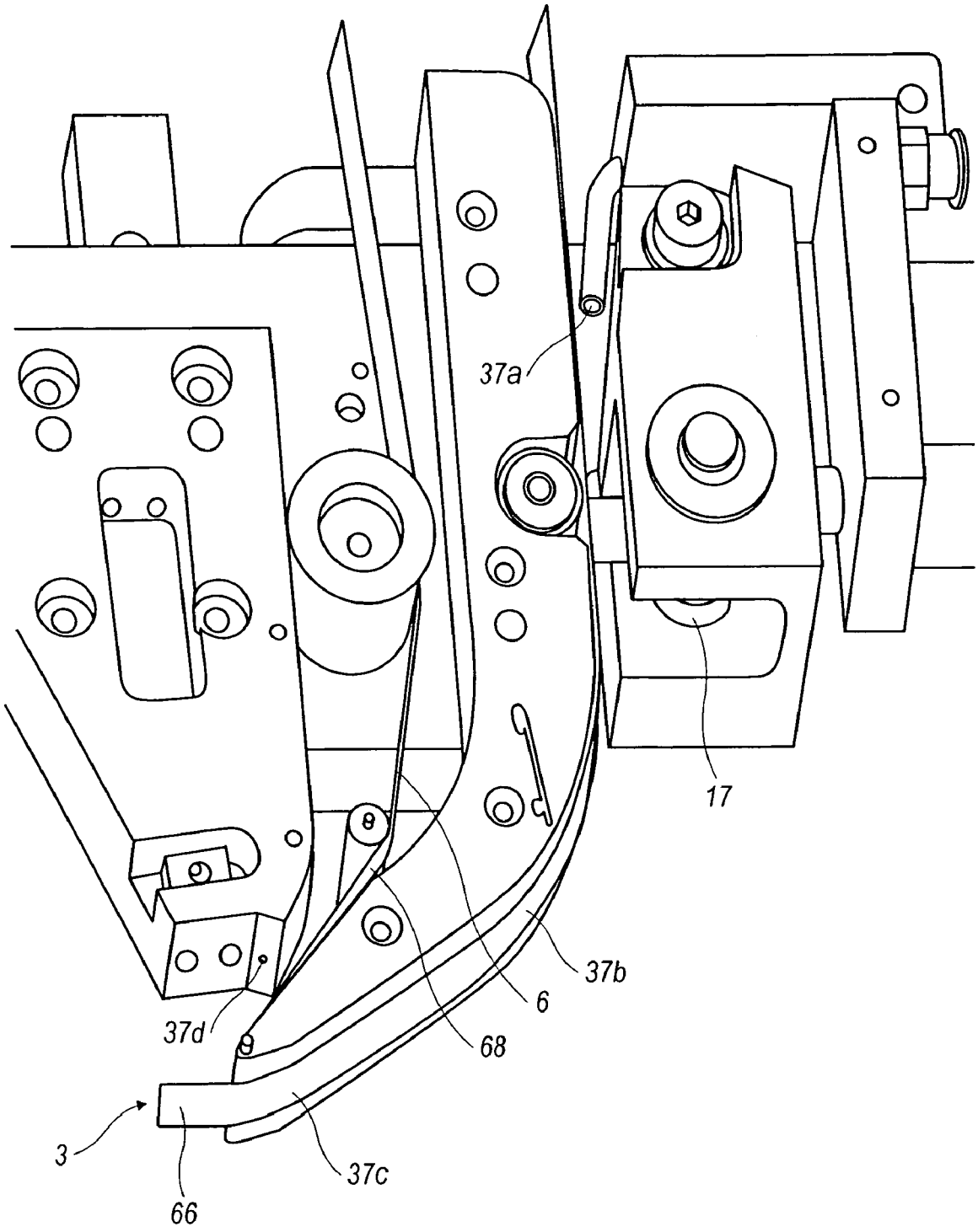
FIG. 15 provides a perspective view of a tape applicator head with air ports in accordance with an exemplary embodiment of the present invention

Referring to FIG. 15, a perspective view of the tape applicator head is illustrated. As shown, The tape applicator head 7 can include one or more air ports or airjets 37 which can be useful in certain areas of high load or contact between the tape 3 and the surface of the nose 9. The number of air ports 37 can vary according to the length and shape of the nose 9. The one or more air ports 37 can provide continuous air, shoot blasts of air, or act as a vacuum. For example, an air port 37*a* can provide continuous air or shoot a blast of air towards the tape 3 after the tape 3 is cut by the cutting means 17. By locating the air port 37*a* near the cutting means 17, the air can assist in separating the tape 3 and the backing for two-sided tape 3. The air or vacuum created by one or more air ports 37 can assist in directing the tape 3 through the tape applicator head 7. For example, one or more air ports 37*b*, 37*c* can assist in maintaining the tape 3 close to the nose 9 of the tape applicator head 7. When vacuum is being drawn, the tape 3 is urged into contact with the tape applicator head 7 by ambient air pressure. Although this vacuum can be turned on and off as required, every such change results in a certain amount of cycling time. Since it is beneficial to reduce cycling times, a constant vacuum can be maintained if it is of a strength which allows the tape 3 to move along its intended path while drawing it into contact with the tape applicator head 7. By using a proper amount of vacuum pressure, the tape 3 is able to move freely. Similarly, one or more air ports 37 can assist in maintaining the tape 3 a distance away from a surface of the tape applicator head 7 by shooting air towards the tape 3, e.g., towards the backing 6 of double sided tape 3. By using the proper amount of air force, the tape 3 is able to move freely. This reduces the friction of the tape 3 on the nose 9 due to the capstan effect and thus further reduces the torque required to feed the tape 3 through the tape applicator head 7. One or more air ports 37*d* can be used to assist the tape 3 to adhere against the surface of a work piece during the application of the tape 3 onto the surface of the work piece. In addition, the one or more air ports 37*d* can assist in separating the backing 6 from the applied tape 3.

The removable backing 6 can be removed by the robotic tape applicator 1 after applying the tape 3 to the work piece. The backing 6 can be removed by any suitable means that does not adversely affect the tape application or operation of the robot (e.g., using a vacuum system to pass the backing material over rollers and then into a collection system). For example, as shown in FIG. 15, the tape 3 is applied to a work piece along the tape path 66 and the backing 6 returns to the tape applicator head 7 where it can be spooled onto a roller (not shown).

Figure 6:
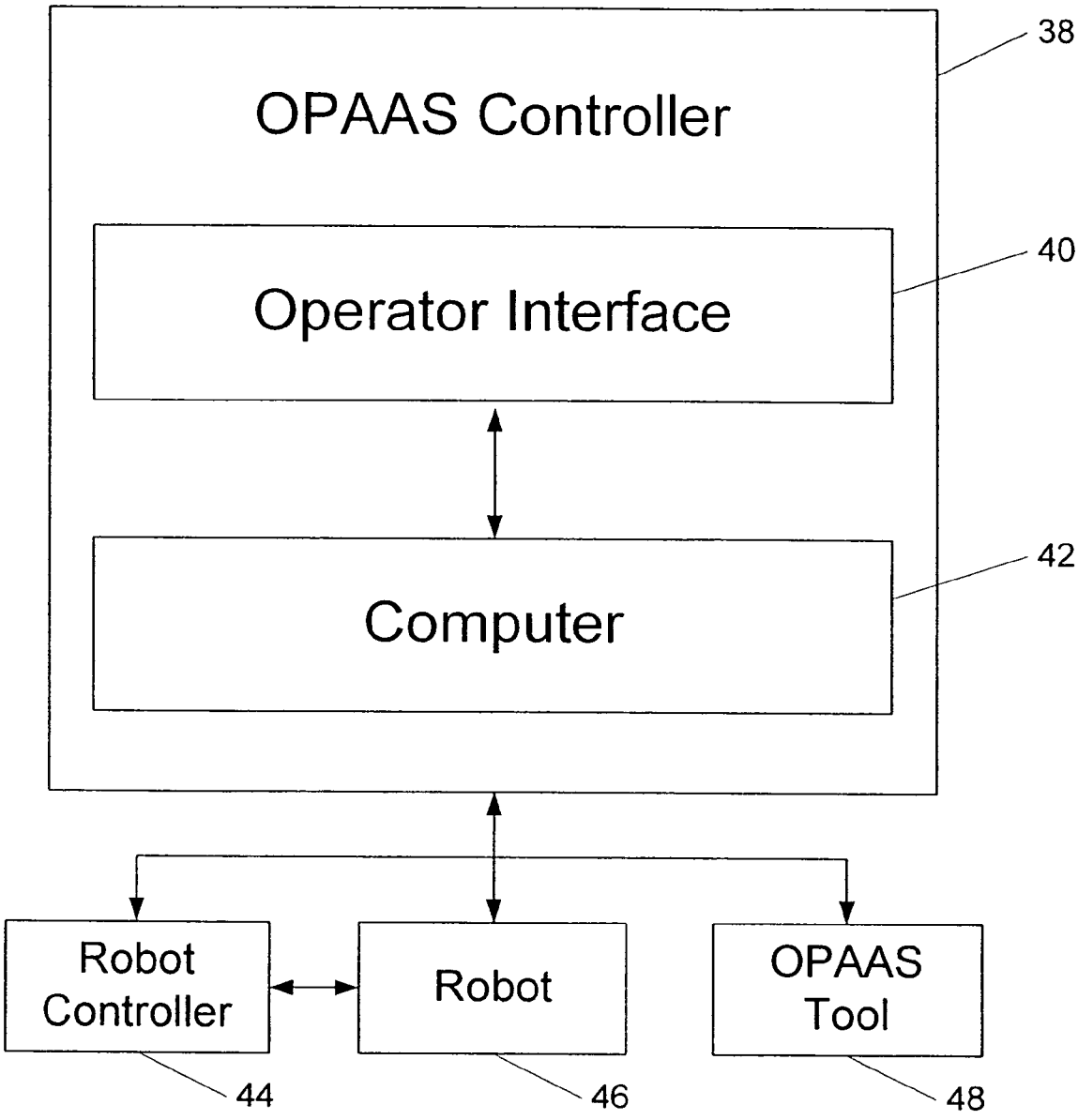
FIG. 6 is a schematic view of selected components in accordance with an exemplary embodiment of the present invention.

Referring to FIG. 6, a block diagram of a robotic tape application system in accordance with an exemplary embodiment of the present invention is illustrated. The robotic tape application system can be controlled by software or an application program which resides on a computer 42 (or processor) and can interact with an operator via an operator interface 40. For example, the computer 42 can be a personal computer and the operator interface 40 can be a touchscreen. The software is hereinafter referred to as the "OPAAS software" and the combination of the computer 42 and operator interface 40 is referred to as the "OPAAS controller" 38. The OPAAS controller 38 enables an operator to interact with a robot or robotic arm 46 and to control the one or more tools 48, e.g., OPAAS tools, attached to the robot 46. For example, an operator, using the OPAAS controller 38 can control an OPAAS tool 48 such as the robotic tape applicator 1, as well as the components on the robotic tape applicator 1 described above with respect to FIGS. 1-5 and below with respect to FIGS. 7-13. The OPAAS software can be supplemented to include new software, e.g., a software module, to interact with any robot 46, e.g., a new robot 46. A tool changer 19 (see FIG. 1) can be used to change the OPAAS tools 48 attached to the robot 46 depending on the requirements of the tape application task. The tool changer 19 can have any desirable structure. Examples of such comprises snap-fittings, compression fittings, manually operated connections, among other means for removably connecting the tape applicator head 7 to the robot 46.

The robot controller 44 controls the robot 46 and can receive and transmit information between the robot 46 and the OPAAS controller 38. The OPAAS controller 38 controls the OPAAS tools 48 and the components on the OPAAS tools 48. The OPAAS controller 38 can receive information from the robot controller 44 or from the robot 46. The OPAAS controller 38 can interact with any suitable robot 46 which can be employed for transporting the robotic tape applicator 1. The robot 46 can be new robot or an existing robot can be retrofitted to receive the robotic tape applicator 1. An example of a suitable commercially available robot 46 comprises a Fanuc S-5 Robot was chosen for the activator and tape application due to the shape and size of the part to be taped. On many of the parts, a large reach combined with the ability to manipulate a tool 48 at a complex tilt is required. The six-axis, articulated robot 46 can be programmed based on the nominal contours of the 3-dimensional mathematical part profile data of a work piece in which tape 3 is going to be applied. The 3-dimensional mathematical part profile can be used to generate the basic tool path for the work piece. Any difference in shape due to moisture content and shrinkage can be accommodated by the end of arm tooling. The robot 42 has the capacity to store a multitude of robot paths. Each of the proposed paths can be programmed into the robot controller 42 via known programming methodology. The proposed paths can be linear, nonlinear, three-dimensional, etc.

Figure 7:
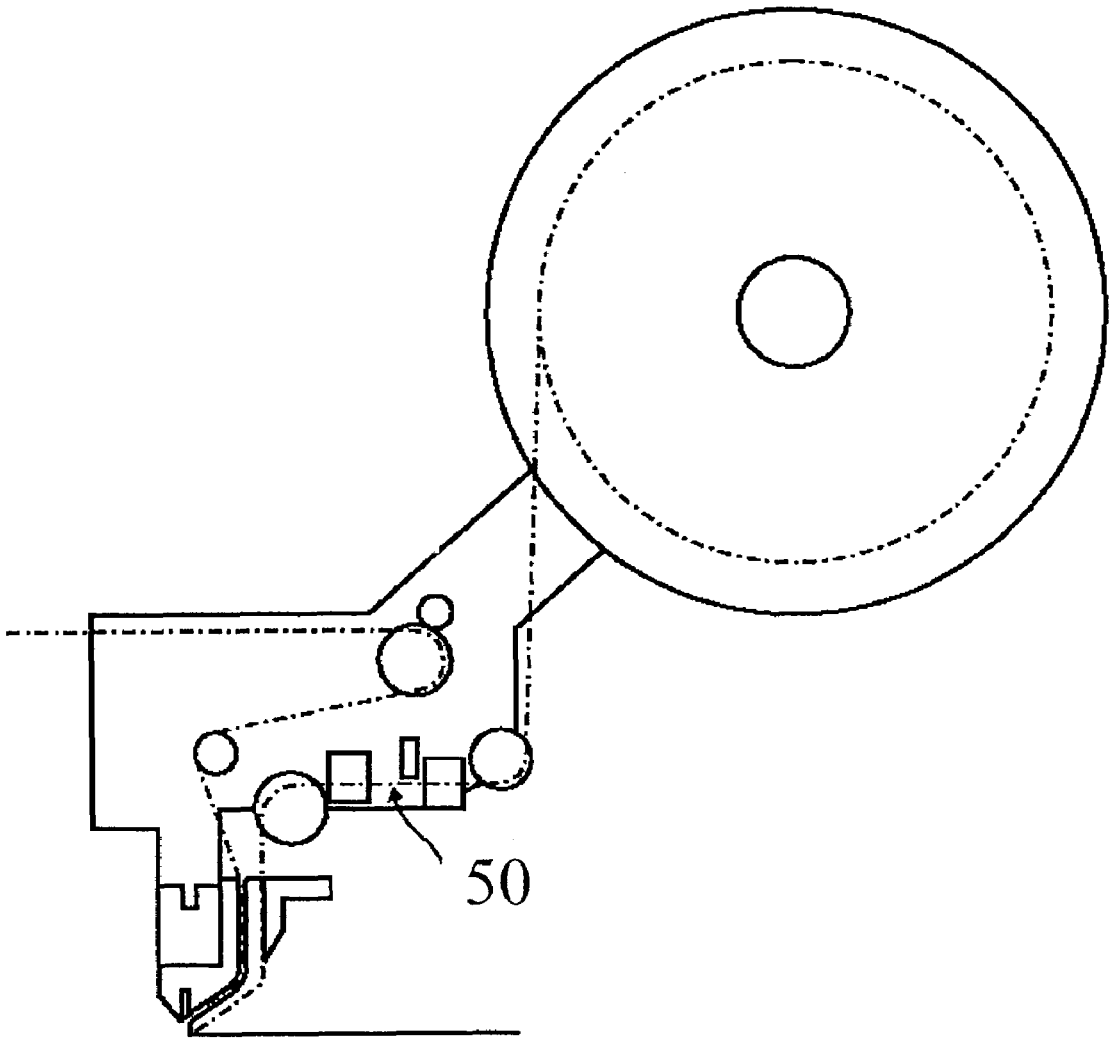
FIG. 7 is a front elevation view of a splicing component in accordance with an exemplary embodiment of the present invention.

The robotic tape applicator 1 illustrated in FIGS. 1-6 can be modified to include at least one of the means illustrated in FIGS. 7-12. Referring to FIG. 7, a splicing component or splicing means for connecting the end of tape from a first roller with the beginning of tape from a second roller is illustrated. By splicing the two tapes 3 together, the spliced tape can be automatically threaded. For two-sided tape 3, the backing 6 can be removed from the beginning and/or end of the tape 3. The splicing component 50 can comprise clamps or other structure that applies a compressive force onto the tape ends. If desired, the splicing component 50 can further comprise a means for applying an adhesive. The adhesive can be employed for connecting the tape ends together. If employed any suitable adhesive can be used such as conventional pressure sensitive adhesive, a double sided splicing tape with a backing for stiffness, among other methods for connecting tape ends. In one aspect, the tape ends include a previously applied adhesive that is protected by a removable tab.

Figure 8:
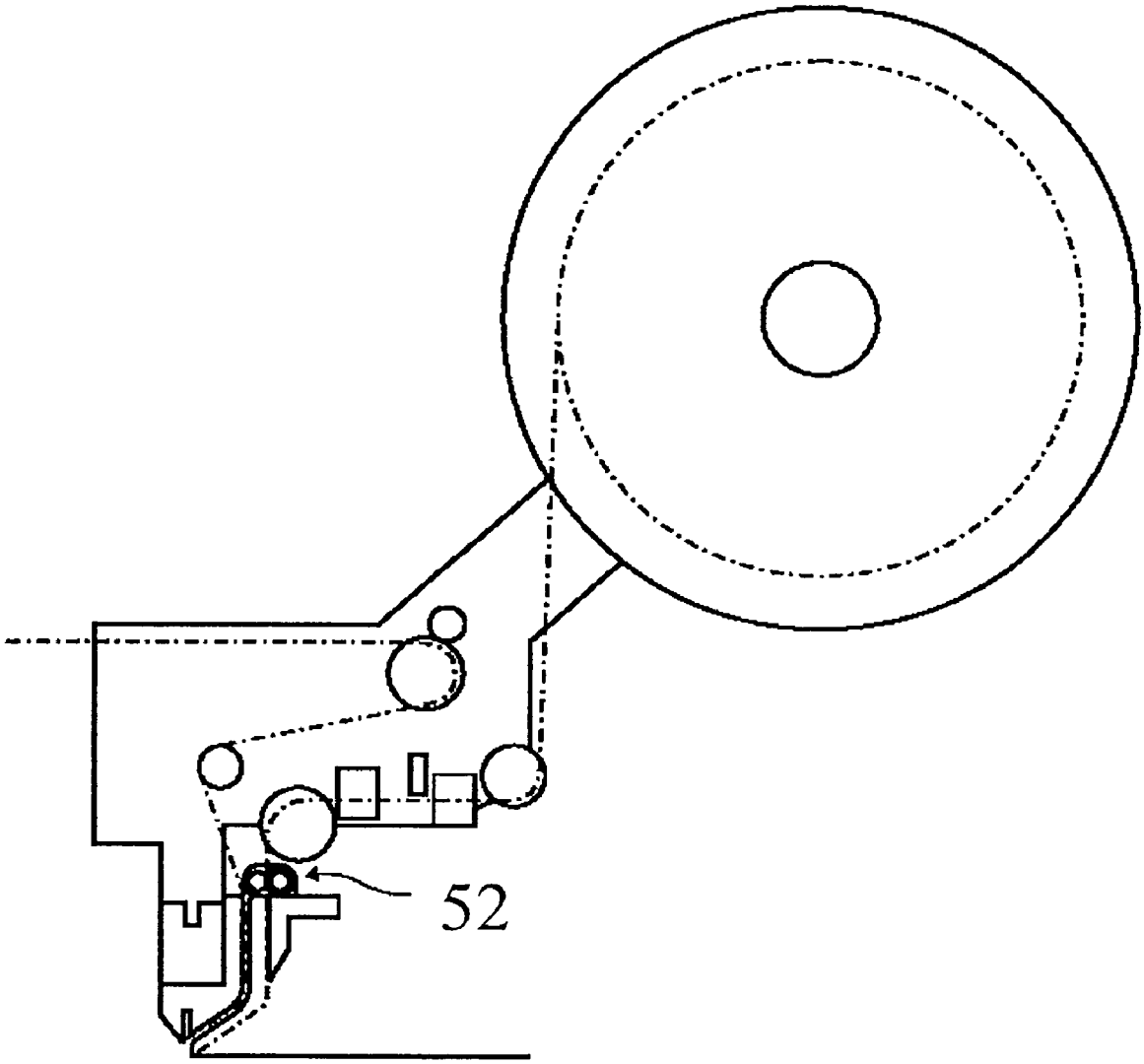
FIG. 8 is a front view of a cutting component in accordance with an exemplary embodiment of the present invention.

Referring to FIG. 8, a cutting station or cutting means for cutting the tape before application is illustrated. The cutting station 52 can be employed for cutting the tape 3 into relatively small pieces (prior to application), embossing, or to ensure that a predetermined length of tape 3 is applied onto the work piece. The cutting can occur before or after the tape 3 is applied to a work piece. The cutting station 52 can include a knife or rotary die 17 to cut the tape 3. In a preferred embodiment, the knife 17 cuts the tape 3 against an anvil. The rotary die can comprise two rollers that are spaced apart a distance to receive the tape 3. The rotary die can also comprise a roller and an anvil (e.g., mandrel) wherein the tape 3 passes between the mandrel and roller. In either case, the cutting station 52 can cut through the tape 3 to be applied but not through the carrier or removable backing of the tape 3. The cutting station 52 can interface with the computer 42 to determine when to cut the tape 3 and determine the velocity that the cutting means needs to cut the tape 3. For example, the rotation speed of the rotary die can approximate the linear velocity of the tape 3 being applied. In a preferred embodiment, the cutting station 52 can cut the adhesive but the not the carrier or backing 6.

Figure 9:
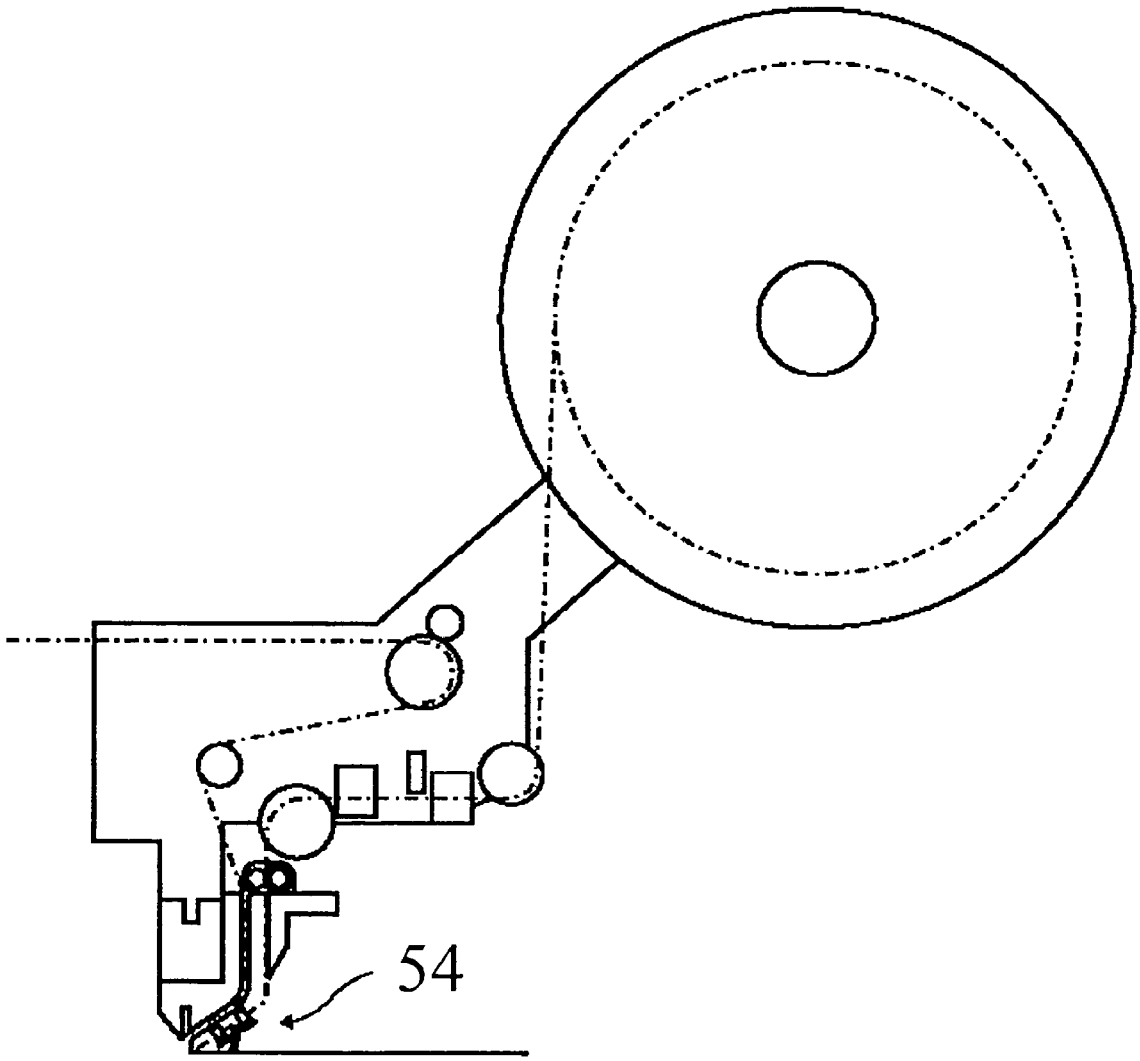
FIG. 9 is a front view of a component for improving tape adhesion in accordance with an exemplary embodiment of the present invention.

Referring to FIG. 9, an adhesion promoting component or means is illustrated. The adhesion promoting component 54 can include a cleaning mechanism to remove or reduce undesirable material or substance, e.g., debris or oil, from a work piece. The cleaning mechanism can be connected to the robotic tape applicator 1 and can clean the work piece immediately before applying tape 3 (e.g., the cleaning mechanism 56 removes undesired substances in the path of the tape applicator head 7). The cleaning mechanism 56 can include a sweeping material such as a sponge, chamois, cork, rubber, among other materials that would produce a squeegee effect, or a tacky material; all of which would remove material from the path of the tape applicator head 7. The cleaning mechanism can also include a system for dispensing a fluid that can assist in removing undesirable materials or substances (e.g., a sponge that dispenses a volatile cleaning solution such as alcohol). If desired an air-blaster or jet blast cleaner (see FIG. 11) can be combined with the cleaning mechanism. The air-blaster can also be used for removing any cleaning fluid. The air-blaster can produce a high velocity blast of air that would blow any debris or oil out of the path of the tape applicator. If desired, the air could also be heated or cooled depending on the desired results.

Figure 10:
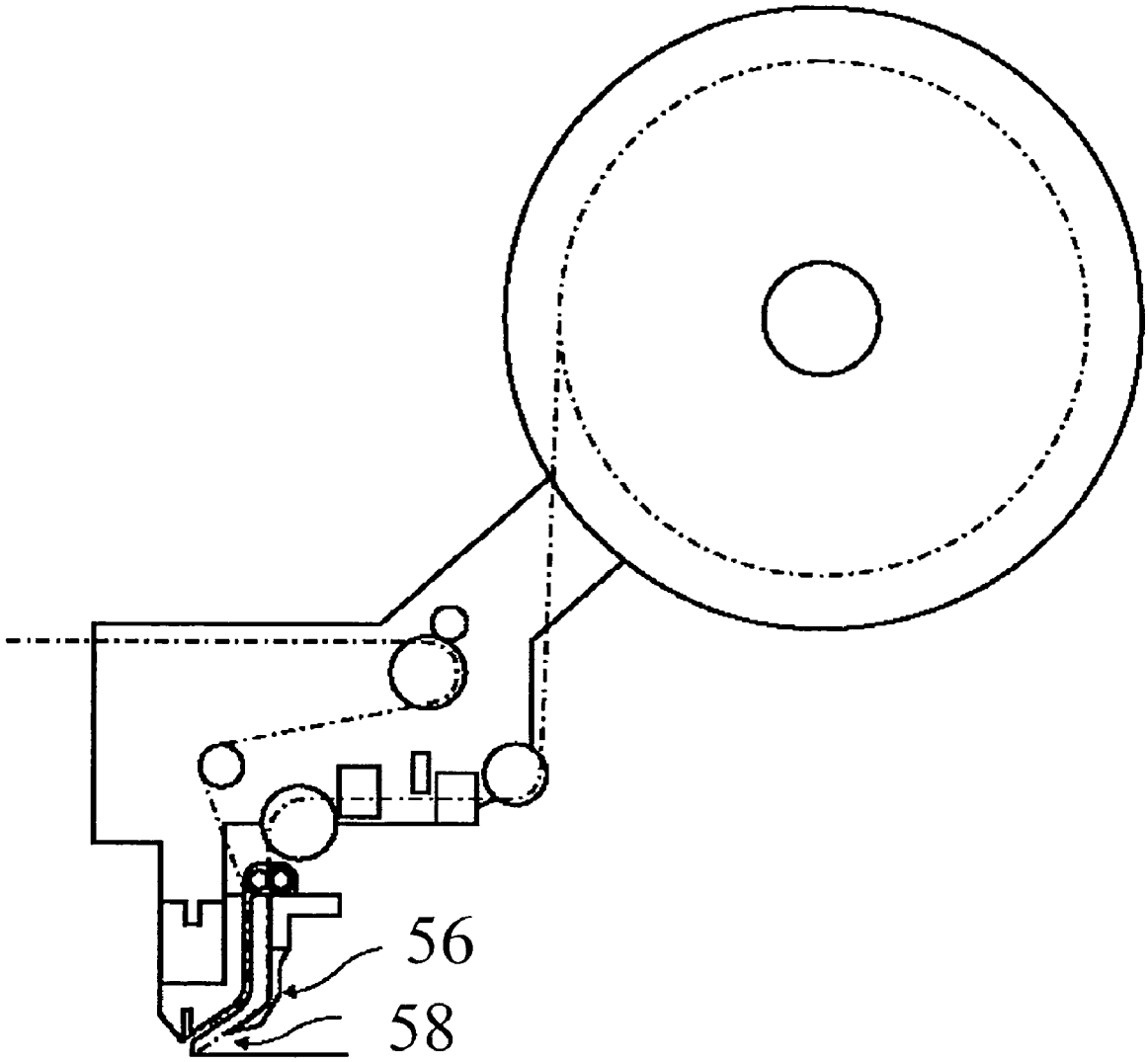
FIG. 10 is a front view of another component for improving tape adhesion in accordance with an exemplary embodiment of the present invention.

Referring to FIG. 10, an alternate adhesion promoting component or means is illustrated. The adhesion promoting component 56 promotes adhesion between the tape and the work piece by heating the tape 3 prior to contacting the work piece. For example, a heater can comprise any suitable means such as an infra-red heater, hot air, among other means for increasing the temperature of the tape 3 and in turn the adhesive qualities of the tape 3 being applied. The heater can be connected to the robotic tape applicator 1 and travel with the robotic tape applicator 1, or in a separate structure (e.g., that is maintained at a fixed location relative to the work piece). If desired, the adhesion promoter component can also heat the surface of the work piece 58.

Figure 11:
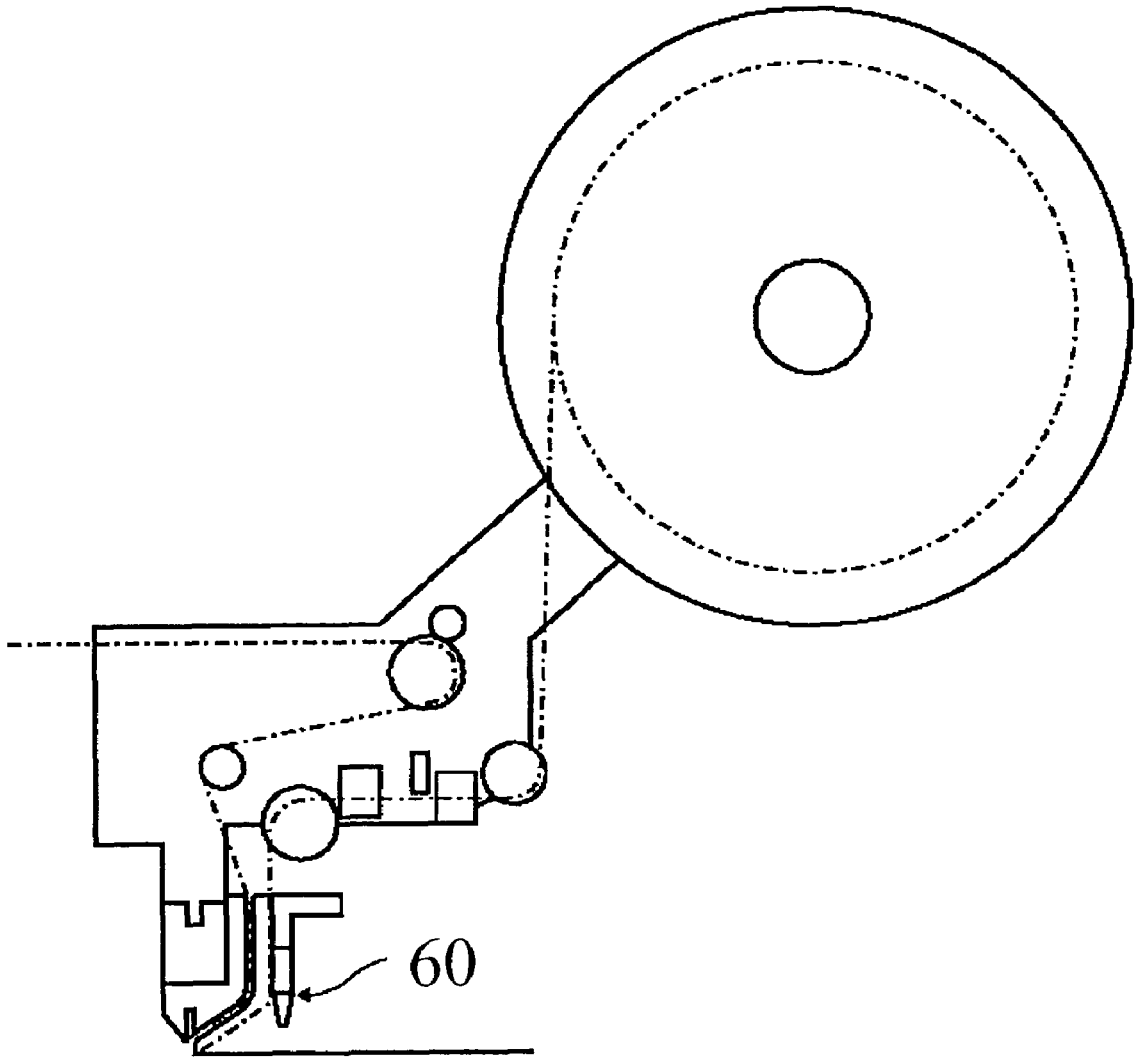
FIG. 11 is a front view of a cleaning component in accordance with an exemplary embodiment of the present invention.

Referring to FIG. 11, another adhesion promoting component or means that cleans and/or heats the work piece surface is illustrated. As shown, a jet blast cleaner or air blaster 60 can blast air onto the work piece to clean the surface of the work piece. In a preferred embodiment, the jet blast cleaner 60 blasts hot air that modifies the surface temperature as well as cleans the work piece surface. The temperature modification can comprise any suitable means (e.g., an infrared heater, water chiller, among other means for either heating or cooling the work piece surface) that is combined with a blowing system (e.g., vortex means). The temperature of the air from the jet blast cleaner 60 can be heated or cooled by adjusting a temperature controller. The jet blast cleaner 60 can be used to heat the surface of a work piece that the sealer is being applied to or can heat the sealer itself. The temperature modification can also function to reduce humidity in the tape application area.

Figure 12:
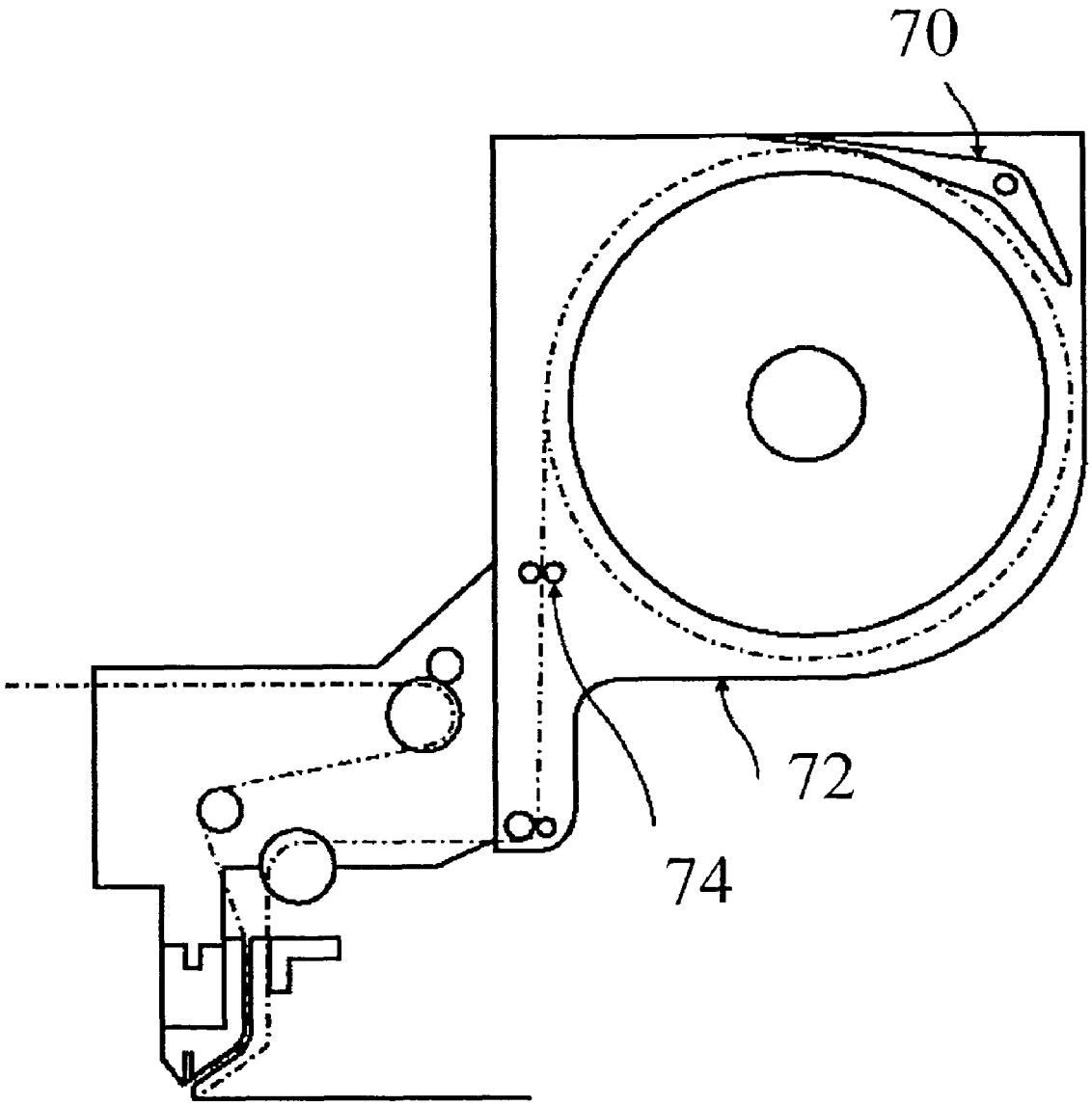
FIG. 12 is a front view of a tape cartridge in accordance with an exemplary embodiment of the present invention.

Referring to FIG. 12, a tape cartridge is illustrated. The tape cartridge 72 can store tape 3 on a roller 5 within the tape cartridge 72. The roller 5 can include a drive mechanism that is geared or self driven and means for removably connecting the tape cartridge 72 to the robotic tape applicator 1, e.g., the main bracket 18. The tape cartridge 72 can include side plates to protect the tape 3 from contamination and to maintain the shape of the tape 3. When the tape 3 needs to be replaced, the tape cartridge 72 can be removed from the robotic tape applicator 1 and replaced with another tape cartridge 72. For example, when the roller 5 is empty and/or a different tape 3 is needed, the tape cartridge 72 can be replaced. An empty tape cartridge 72 can be refilled with tape 3. The tape cartridge 72 can be fabricated from any suitable material such as plastic, injection-molded thermoplastic, among other suitable materials. In a preferred embodiment, a one way bearing is used keep the tape 3 from slipping during shipping. A roll balancer 70 can be used to assist in maintaining the shape and quality of the tape 3 during shipping and storage. In an alternate embodiment, a self-threading machine or means could be used introduce tape 3 from a roller 5 into the tape applicator 7 (e.g., when the tape 3 is not loaded into a cartridge). This could comprise a miniature robot that could take the sealer off the reel and thread it through the tape applicator head 7. This self-threading machine could be located on the tape applicator head 7 or in a different location. The tape cartridge 72 can also include a roll balancer 70 and one or more nip rollers 74. The roll balancer 70 can assist in maintaining the tape on the roller 5 to protect the shape and quality of the tape 3. The nip rollers 74 can assist in directing the tape 3 within the tape cartridge 72 and into the tape applicator head 7.

Figure 13:
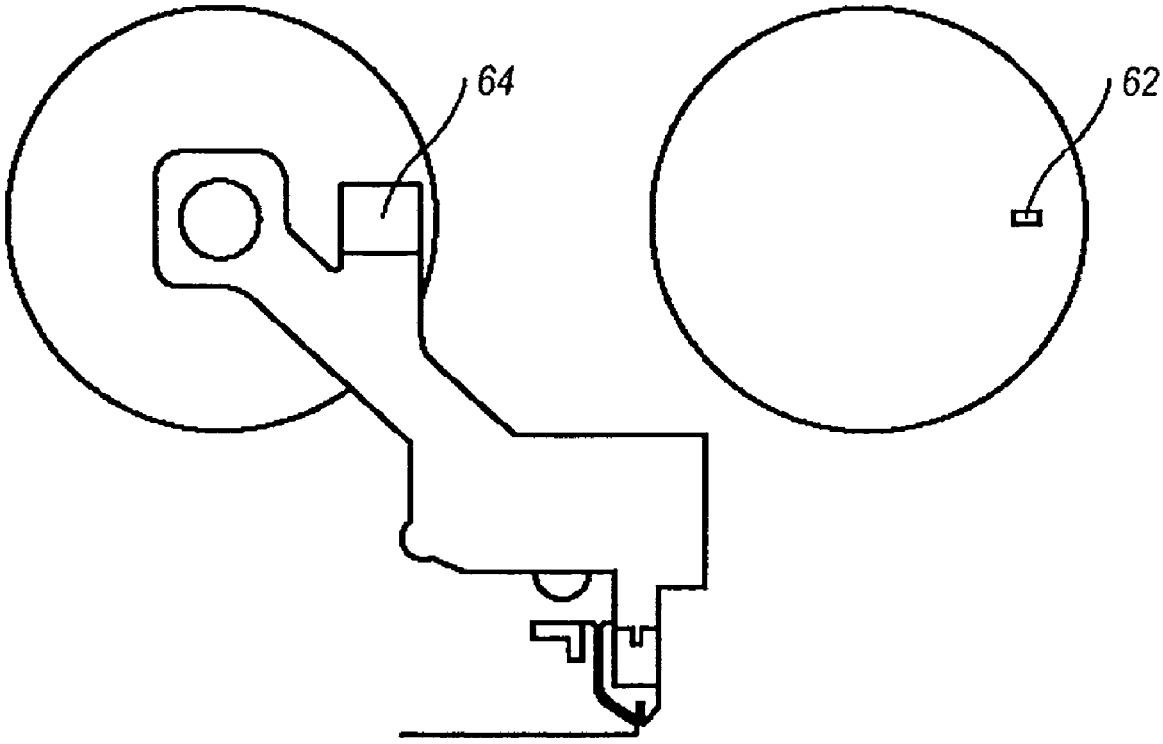
FIG. 13 is a front view of a tape cartridge having an optical reader in accordance with an exemplary embodiment of the present invention.

Referring to FIG. 13, an identification tag for identifying the tape on a roller is illustrated. As shown, an identification tag 62 is on the roller 5. The identification tag 62 can be a bar code, a magnetic strip, an radio frequency identification (RFID) tag, or other known means to provide information regarding the material on the roller 5. The information contained in the identification tag 62 can comprise product number/type, date of manufacture, length, path/application pattern, application speed, among other tape and application specific information. This information can be used to ensure that the appropriate product, e.g., tape, and amount thereof is applied onto the work piece. A reader 64 obtains the information contained in the identification tag. For example, a bar code reader or an interrogator 64 attached to the main bracket 18 obtains the information from the identification tag 62. The information is provided to the computer 42 (e.g., refer to FIG. 6) prior to applying the tape 3. The computer 42 can accept the information and proceed with tape application, or reject the tape cartridge 72 (and report an error, signal an operator, etc.). The identification tag 62 or information can be located at any suitable location such as on an exterior surface of the tape cartridge 72. In alternate embodiments, the information can be stored on the tape, e.g., as a leader or on the beginning portion of the tape, among other locations accessible by the reader or interrogator 64.

Figure 14:
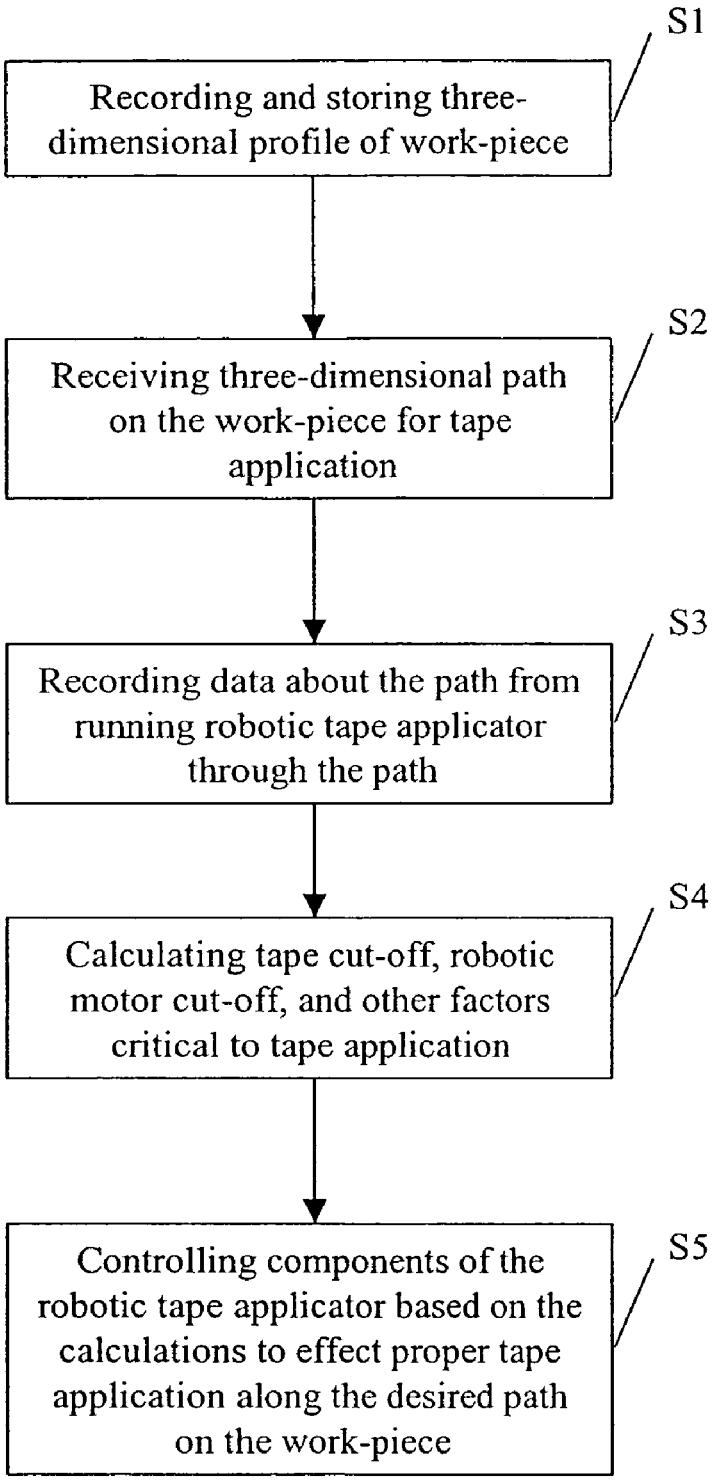
FIG. 14 is a process flow for a tape application methodology in accordance with an exemplary embodiment of the present invention.

Referring to FIG. 14, a methodology for applying tape onto a work piece in accordance with an exemplary embodiment of the present invention is illustrated. This exemplary method is provided by way of example, as there are a variety of ways to carry out methods according to the present invention. The method shown in FIG. 14 can be executed or otherwise performed by one or a combination of various systems. The method described below can be carried out using the system illustrated in FIG. 6 by way of example, and various elements of the illustrated system are referenced in explaining the exemplary method in FIG. 14. Each block shown in FIG. 14 represents one or more processes, methods or subroutines carried in the exemplary method. In other embodiments, the steps or blocks in FIG. 14 can be combined and/or repeated depending on the embodiment.

At step S1, the three-dimensional profile of one or more work pieces, e.g., body parts, on which a tape 3 is to be applied, is recorded and stored in the computer 42, e.g., in memory or in an electronic database. After storing the one or more profiles, the method proceeds to step S2.

At step S2, based on the stored information about the work piece, an operator of the robotic tape applicator system can input or program into the robot controller 42, a three-dimensional path for the robotic tape applicator 1 to travel to apply tape 3 onto the work piece. Using the robot controller 44, the operator can program the plurality of different points through a number of ways as understood by one skilled in the art based on a reading of the present disclosure. For example, the operator can enter the actual coordinates for the desired points along the path, in accordance to the stored three-dimensional profile of the work piece. The number of points desired for a particular path depends on the desired accuracy of the tape application along the path and the complexity of the path. After storing the proposed path, the method proceeds to step S3.

At step S3, the robotic tape applicator is run at least once, through the path based on the designated points, to allow the OPAAS controller 38 (OPAAS software) to automatically monitor and capture data about the path necessary for the tape application along the path. If needed, the operator can correct the three-dimensional profile of a work piece if the profile of an actual work piece differs from the stored profile. In one embodiment, the OPAAS controller 38 monitors the tape applicator head 7 and its velocity as the robotic tape applicator system is run along the path the tape 3 is going to be applied to a work piece. For example, the robot 42 or robot controller 44 can provide velocity information regarding the tape applicator head 7 to the OPAAS controller 38. The OPAAS controller 38 uses this information to calculate the length of the path and the required amount of tape 3 that is being applied, e.g., fed by the robotic tape applicator 1. In an alternate embodiment, the robotic tape applicator 1 can include one or more counters (not shown) can provide information to the OPAAS controller 38 regarding how much tape 3 has been dispensed. The OPAAS controller 38 stores the calculated length of tape needed in memory, e.g., an electronic database. The OPAAS controller 38 robot controller 44 or robot 46 can also provide an indication where the tape application begins. Thus, the OPAAS controller 44 uses the starting point and the velocity of the tape applicator head 7 to determine how much tape 3 is applied and when to cut the tape 3. This step can be repeated for each piece of tape 3 that is being applied to a work piece. After the OPAAS software monitors and captures data about the path, the method proceeds to S4.

At step S4, based on the monitored and captured data about the path, the OPAAS software is run a second time to automatically calculate where to cut the tape 3 at about an end point, when to turn on and off components, e.g., pressure cylinder 2, knife blade 17, control piston 4, braking assembly 21, air ports 37, splicing component 50, adhesion promoter 52, cutting station 52, adhesion promoting component 54, 56, jet blaster cleaner 60, the motors in the tape applicator head 7 (which can affect the actual end point of the sealant on the surface of the work piece), and other factors critical to the tape application. The OPAAS software determines when to turn these components on and off based on the length of tape and the velocity of the tape applicator head 7. According to one embodiment, a standard cutting speed during all cuts is adopted to minimize error in the cut length in paths with different application speed, wherein an optimal cutting speed is determined, applied to all paths, and adopted as a "rule" for path programming. Optimal cutting speed is a function of the material type, thickness and width of the tape. Cutting speeds are determined with empirical testing results on that particular material type to be applied. Thus, the OPAAS software can calculate when the cutting means, e.g., the knife blade 17, needs to be actuated based on the length of tape 3 that is dispensed This calculation takes into account the mechanical and electrical time constants of the cutting means and adjusts accordingly. For example, slight variations in mechanical time constants of different cutting means or tools require each tool to be calibrated to determine the timing offset required to keep cut length consistent from tool to tool. A global offset for each tool can be predetermined and loaded into the OPAAS software during the time of startup of that particular cutting tool so as to achieve the optimal cutting speed for all cuts.

In another embodiment, the cutting means must be actuated faster or slower depending on the velocity of the robotic tape applicator 1 and/or the tape applicator head 7 in order for the end point of the tape 3 to be the same. The OPAAS controller 44 further allows the operator to input and finely change the end point (e.g., using an end-point slider) so as to trim the end point and affect the actual end point of the tape 3 on the surface of the work piece. This is important for a clean separation between the tape 3 applied on the surface of the work piece and the tape 3 remaining on the tape applicator head 7. In addition, based on the location of the tape applicator head 7, the operator can also determine where different functions can start and end. For example, when the adhesion promoter 52 is applied, when to heat the tape 3, when to shoot a blast of air, etc. This can also be done in a separate step. After the OPAAS software determines the control points for controlling the robotic tape applicator 1, the method proceeds to step S5.

At S5, based on the above calculations, the tape application is performed and the OPAAS controller 44 controls the various components of the robotic tape applicator 1 to effect proper tape application to the work piece along the desired path. Again, since the velocity of the tape applicator head 7 can differ based on the individual robot 46 being used, the OPAAS controller 44 is able to account for differences between individual robots 46 to consistently and efficiently apply tape 3 to work pieces.

During tape application, the OPAAS controller 44 can also communicate or interface with external programmable controllers for the robot cell that controls movement of the robotic tape applicator 1 and its tape applicator head 7 for health monitoring of the tape application. This ensures that the tape application is functioning properly and moving forward without any errors. Health monitoring can include monitoring various sensors to determine how much tape 3 is on the roller 5, whether the tape 3 is moving at substantially the same speed as its application through the tape applicator head 7, whether the pulling of the tape backing 6 is being done at substantially the same speed as the tape application through the tape applicator head 7, the position of the knife blade 17, the position of the compliance pressure cylinder 2 which controls how much pressure the nose 9 puts on work piece (the compliance pressure can be controlled by the OPAAS software, and it is adjustable as an input from the operator based on how much oil is on the work piece surface), etc. For example, the OPAAS controller 44 can monitor the level of tape 3 in the head via sensors in the tape applicator head 7, which indicate when there is two or three cycles of tape 3 left. This can be used to alert the operator and a countdown can be initiated to determine when to replace the tape cassette 72. The OPAAS controller 44 can also monitor if the tape cassette 72 has been dropped off and if the tape 3 has been replenished. The OPAAS controller 44 can also monitor if the covers of the tape applicator head 7 are on or before moving the tape applicator head 7 away from the tool post area. In one embodiment, the OPAAS controller 44 controls all aspects of actuation of all pneumatic devices and electric motors on the tape applicator head 7 in a specific order. Timing of each event can be changed through the OPAAS controller 44. These types of system parameters can be established at the factory or by the operator as desired based on the type of material being applied to the tape applicator head 7.

The OPAAS controller 44 can also interface with other controllers or control devices in the robot cell for seamless integration, whereby the OPAAS controller 44 can further monitor the status and health of the robot cell before allowing the tape application to proceed. For instance, the OPAAS controller 44 can interface with a supervisory controller in the robot cell that typically controls ancillary functions such as tasks like tool drop-off, doors opening and closing, part rotation, etc. To that end, the OPAAS controller 44 can include software modules to accommodate different communication protocols (e.g., Interbus-S, Profibus, Ethernet) used by those controllers with which the OPAAS controller 44 (and thus the OPAAS software) interfaces or communicates. Thus, the OPAAS software can include multiple software modules to afford communication with the various controllers.

The OPAAS software can include additional software modules to perform additional functions. For instance, a software module can be added to interface with an external vision system (not shown), or other sensors fitting to the OPAAS controller 44 for autoVScan capability. As referred herein, autoVScan is the ability to automatically detect what the tape 3 or tape cassette 72 is installed on the main bracket 18 for verification of appropriate tape types, batch information such as shelf life, date of manufacture etc. As mentioned earlier, this information could be encoded on the reel of tape 3 via the identification tag 62 thus ensuring that only approved tapes 3 can be allowed to run on the system or that the wrong type is not used.

While the above description emphasizes using the tape applicator head 7 for applying tapes 3, e.g., an adhesive, a sealant, structural or sound abatement material upon an automotive component, the tape applicator head 7 can be used for applying tape 3 to a wide range of automotive and non-automotive surfaces. Examples of such surfaces comprise steel, galvanized metal, aluminum, among other metals, glass, composites, carpets, pads, plastic, alloys and materials used in automotive construction. Examples of additional automotive and non-automotive components comprise previously painted articles, exterior and interior trim articles, among other areas of an automobile. In addition, the tape head can be employed for applying tape to non-metallic surfaces such as plastic, foam, wood, among other materials wherein it is desirable to apply a tape.

The invention has been described with reference to certain aspects. These aspects can be employed alone or in combination. Modifications and alterations will occur to others upon a reading and understanding of this specification. It is understood that mere reversal of components that achieve substantially the same function and result are contemplated. It is intended to include all such modifications and alterations insofar as they come within the scope of the appended claims or the equivalents thereof.

What is claimed is:

1. A method for applying a material to a work piece comprising:

storing path data for a predetermined path for applying a material to a work piece;

storing length data for the length of the material to be applied to the work piece;

determining when to cut the material using, at a minimum, the length of the material to be applied, the velocity of a material applicator apparatus applying the material, and the speed of a cutting component cutting the material;

applying the material to the work piece along the predetermined path using the material applicator apparatus; and cutting the material at the determined time using the cutting component in the material applicator apparatus.

2. The method of claim 1 wherein the path data is stored in an electronic database.

3. The method of claim 1 wherein the length data is stored in an electronic database.

4. The method of claim 1 wherein the length data is based on a starting point to apply the material and the velocity of the material applicator apparatus.

5. The method of claim 1 wherein the material is a double-sided adhesive tape.

6. The method of claim 1 wherein the predetermined path is non-linear.

7. The method of claim 1 further comprising locking the material in place during the cutting of the material.

8. The method of claim 1 wherein cutting the material occurs prior to completion of applying the material to the work piece.

9. The method of claim 1 wherein determining when to cut the material using the speed of the cutting component cutting the material further comprises using a mechanical time constant and an electrical time constant of the cutting component.

10. A system for applying a material onto a work piece, the system comprising:

a material applicator apparatus for applying material onto the work piece; and a controller configured for:

storing path data for a predetermined path for applying the material to the work piece;

storing length data for the length of the material to be applied to the work piece;

determining when to cut the material using, at a minimum, the length of the material to be applied, the velocity of a material applicator apparatus applying the material, and the speed of a cutting component cutting the material;

applying the material to the work piece along the predetermined path; and cutting the material at the determined time using the cutting component in the material applicator apparatus.

11. The system of claim 10 further comprising a robot configured to follow the determined path for applying the material.

12. The system of claim 11 wherein the material applying apparatus is coupled to the robot.

13. The system of claim 11 wherein cutting the material occurs prior to completion of applying the material to the work piece.

14. The system of claim 10 wherein the length data is based on a starting point to apply the material and the velocity of a component of the material applicator apparatus.

15. The system of claim 10 further comprising a first electronic database for storing the path data.

16. The system of claim 15 further comprising a second electronic database for storing the length data.

17. The system of claim 10 further comprising wherein the cutting component further comprises a knife blade.

18. The system of claim 10 wherein the controller is further configured for locking the material in place during the cutting of the material.

19. The system of claim 10 wherein determining when to cut the material using the speed of the cutting component cutting the material further comprises using a mechanical time constant and an electrical time constant of the cutting component.

20. A computer-readable medium on which is encoded program code comprising:

program code for storing path data for a predetermined path for applying a material to a work piece;

program code for storing length data for the length of the material to be applied to the work piece;

program code for determining when to cut the material using, at a minimum, the length of the material to be applied, the velocity of a material applicator apparatus applying the material, and the speed of a cutting component cutting the material;

program code for applying the material to the work piece along the predetermined path using a material applicator apparatus; and program code for cutting the material at the determined time using a the cutting component in the material applicator apparatus.

21. The computer-readable medium of claim 20 wherein the path data is stored in an electronic database.

22. The computer-readable medium of claim 20 wherein the length data is stored in an electronic database.

23. The computer-readable medium of claim 20 wherein the length data is based on a starting point to apply the material and the velocity of the material applicator apparatus.

24. The computer-readable medium of claim 20 wherein the material is a double-sided adhesive tape.

25. The computer-readable medium of claim 20 wherein the predetermined path is non-linear.

26. The computer-readable medium of claim 20 further comprising program code for locking the material in place during the cutting of the material.

27. The computer-readable medium of claim 20 wherein cutting the material occurs prior to completion of applying the material to the work piece.

28. The computer-readable medium of claim 20 wherein determining when to cut the material using the speed of the cutting component cutting the material further comprises using a mechanical time constant and an electrical time constant of the cutting component.

* * * * *